US005613242A

United States Patent [19]

Oddo

[11] Patent Number: 5,613,242

[45] Date of Patent: Mar. 18, 1997

[54] METHOD AND SYSTEM FOR DISPOSING OF RADIOACTIVE SOLID WASTE

[76] Inventor: John E. Oddo, 2907 Albans, Houston, Tex. 77005

[21] Appl. No.: 349,948

[22] Filed: Dec. 6, 1994

[51] Int. Cl.[6] ..... G21F 9/00

[52] U.S. Cl. ..... 588/17; 588/16; 405/128

[58] Field of Search ..... 588/16, 17; 405/128

[56] References Cited

U.S. PATENT DOCUMENTS

| | | | |
|---|---|---|---|
| 3,513,100 | 5/1970 | Stagner . | |
| 4,400,314 | 8/1983 | Ellis et al. | 252/633 |
| 4,429,740 | 2/1984 | Malinchak | 166/53 |
| 4,560,503 | 12/1985 | Bradley | 252/633 |
| 4,632,601 | 12/1986 | Kuwana | 405/128 |
| 4,738,564 | 4/1988 | Bottillo | 405/128 |
| 4,844,162 | 7/1989 | Maassen et al. | 166/267 |
| 4,942,929 | 7/1990 | Malachosky et al. | 175/66 |
| 4,973,201 | 11/1990 | Paul et al. | 405/264 |
| 4,980,077 | 12/1990 | Morris et al. | 252/82 |
| 5,022,787 | 6/1991 | Kuragasaki et al. | 405/128 |
| 5,049,297 | 9/1991 | Morris et al. | 252/80 |
| 5,106,424 | 4/1992 | Rez | 134/4 |
| 5,133,625 | 7/1992 | Albergo et al. | 405/263 |
| 5,145,515 | 9/1992 | Gallup et al. | 75/712 |
| 5,171,103 | 12/1992 | Bernhardt | 405/128 |
| 5,192,163 | 3/1993 | Fleming | 405/128 |
| 5,192,164 | 3/1993 | Frint et al. | 405/128 |
| 5,207,532 | 5/1993 | Mason et al. | 405/128 |
| 5,314,265 | 5/1994 | Perkins et al. | 405/128 |

*Primary Examiner*—Ngoclan Mai
*Attorney, Agent, or Firm*—Gunn & Associates

[57] ABSTRACT

This invention discloses a system and method for the disposal of solid waste that contains radioactive material. Radioactive solid wastes generated as scales during oil and gas production operations are collected and placed in a central processing chamber. High-temperature and high-pressure water containing large amounts of dissolve salts is produced from a geothermal subterranean formation and introduced into the solid processing chamber to dissolve the radioactive solid waste. The solid radioactive waste is subjected to a grinding process to microemulsion particle size and treated in an acid.

22 Claims, 4 Drawing Sheets

METHOD AND SYSTEM FOR DISPOSING OF RADIOACTIVE SOLID WASTE

FIELD OF INVENTION

The present invention relates to a solid waste disposal system for disposing solid waste containing naturally occurring radioactive material in a safe and economic manner. More specifically, this invention relates to a solid waste disposal system that utilizes geothermal means and/or naturally available hydraulic power to dissolve radioactive deposits which accumulate typically during petroleum production operations, and inject the resultant solution, which could be a dilute solution or concentrated sludges, containing such radioactive material into a subterranean geological formation in an economical, safe and environmentally acceptable manner.

BACKGROUND OF THE INVENTION

In oil and gas production operations, water often is produced concurrently with oil and/or gas. The-rate of water production relative to oil and/or gas is determined by the relative permeability characteristics of the reservoir rock and the relative saturation of water contained therein. In many oil and gas production operations, it is not uncommon to have the percentage of water production, or water cut, in the range between 50% to 90% of the total fluids produced, or more. High percentage of water cut is often observed during the mid- or later-stage of the primary production after water breakthrough. A substantial increase in the water cut of the produced fluids is often observed during the so-called secondary recovery operation processes, in which large amounts of water are injected via a pumping means or a naturally occurring mechanism such as pressure differential or gravity heads from the surface into the subterranean formation to maintain reservoir pressure and sustain oil and gas production.

Most subterranean waters contain large amounts of alkaline earth metal ions, such as barium, strontium, calcium, and magnesium. Water injection during the secondary oil recovery operations also dissolves such ions from the reservoir rocks and brings them to the surface. Under the reservoir conditions, these alkaline earth metal ions can co-exist in a thermodynamically stable state with many anions, such as sulfate, bicarbonate, carbonate, phosphate, and fluoride, etc. However, when the subterranean waters are brought up to the surface during the production of oil and gas, the stable state may no longer be maintained, mainly due to temperature and/or pressure changes. Such a change of solution condition often causes the alkaline earth metal ions to form inherent deposits, or scales, with many of the anions. The presence of barium sulfate often represents a unique and particularly troublesome problem because barium sulfate has a very low solubility. At room temperature, or about 25 degrees Celsius, the solubility of barium sulfate is only 2.3 milligrams per liter.

Another problem associated with the formation of the barium sulfate scales, or any other alkaline earth scales, is that radium, another member of the alkaline earth group of metals, also tends to be deposited at the same time. Disposal of such radioactive solid wastes becomes a serious problem in the oil and gas production operations. Such radioactive waste may be referred to as naturally occurring radioactive material (NORM).

Using the example of a typical oil production field which produces about 100,000 barrels of oil per day at a water cut of 50% at the surface, the amount of barium scale produced can be as high as 60 pounds per day. Continued oil production operation inevitably results in higher water cut and a greater amount of barium sulfate scale. Although only a very small amount of radium is deposited with the barium scale, the entire solid waste mass must be considered radioactive, as far as solid waste disposal is concerned. The expense to be incurred to dispose such radioactive solid waste is enormous, if one is fortunate enough to find a site willing to accept its disposal.

Scale, including NORM, forms in wells and production facilities as a function of the temperature and pressure changes associated with producing hydrocarbons and/or the mixing or commingling of incompatible waters, e.g. waters high in barium with waters relatively high in sulfate. As shown in FIG. 3, barium sulfate becomes more soluble when heated. In addition, it also becomes more soluble when the ionic strength (salt content) of the solution is increased. Both of these conditions can be obtained by using the produced waters from a hot salt water producing well. Typically, these wells would be producing wells in the oil and gas field that produce significant amounts of associated water. The heat energy of the well is used to increase the solubility of the barium sulfate in the presence of salt water. Steam is not a viable alternative since solids are not practically soluble in steam.

Various proposals have been made in the prior art for the removal of barium sulfate scales using chemical scale removal compositions. Examples of barium sulfate scale removal techniques can be found in U.S. Patent No. 2,877,848; U.S. Pat. No. 3,660,287; U.S. Pat. No. 4,708,805; U.S. Pat. No. 4,190,462; U.S. Pat. No. 4,215,000; U.S. Pat. No. 4,288,333; U.S. Pat. No. 4,973,201; and U.S. Pat. No. 4,980,077. All these prior art technologies are designed to remove scales from equipment or tubular goods, such as meters, valves, tubing strings, surface pipes, etc. None of the prior art addresses the issue of the disposal of the radioactive solid waste, nor is any prior art known. Also, the use of chemical scale removing agents is subject to a large number of variables. They usually require a right combination of environmental variables in order to work, and yet even under the right conditions they do not always work. Furthermore, since a large amount of solution is required to dissolve the scale, it is essentially economically prohibitive to use such chemical means in the waste disposal process. The techniques proposed in the prior art are to be used for spot-wise dissolution of scales formed on pipes or other equipment, but they are not suitable for handing solid waste disposal.

U.S. Patent No. 4,973,201 discloses a method for decontaminating surface layers of the earth which are contaminated with precipitates of alkaline earth metal sulfates including radium sulfate. The method includes applying an aqueous chemical composition comprising a chelating agent and a synergist to the surface layers in situ to bring the precipitates into dissolved form after which the dissolved precipitates are leached into lower layers of the earth by percolation with water.

U.S. Pat. Nos. 4,980,077 and 5,049,297, which are assigned to the same entity as the '201 patent described above, generally disclose a method and composition, both utilizing a chelating agent, for removing barium sulfate scale deposits from oil field articles.

U.S. Pat. No. 5,022,787 discloses a method for disposing of noncondensing and toxic geothermal gases wherein the gases are returned to the underground.

U.S. Pat. No. 4,632,601 discloses a system for disposing of non condensable gases from geothermal wells wherein the non-condensable gases are dissolved into geothermal waste water.

U.S. Pat. No. 4,429,740 discloses a gas producing well wherein waste water is disposed of in an earth formation underlying the gas-producing earth formation.

U.S. Pat. No. 4,400,314 discloses a method for disposing of high level radioactive water wherein an aqueous solution is diluted with formation water recovered from a subsea reservoir in a porous geological formation and the dilute solution is injected into the geological formation.

U.S. Pat. No. 4,738,564 discloses a method for disposal of nuclear and toxic wastes wherein the wastes are rendered harmless by dilution into a huge mass of molten lava.

Finally, U.S. Pat. No. 4,844,162 discloses a method of treating a flow of hot, pressurized, hydrogen sulfide-containing geothermal steam. This method teaches disposal of condensate in a disposal well but offers no suggestion or even consideration of the difficulties involved in the disposal of solid NORM.

SUMMARY OF THE INVENTION

The primary object of this invention is to provide a method utilizing geothermal means to dispose solid waste containing radioactive material. More particularly, the primary object of this invention is to provide a method by which solid wastes containing radioactive materials—mainly barium sulfate scale with radium ions deposited thereon, which are accumulated during the oil and gas productions, can be disposed in an economic, safe and environmentally acceptable manner. Further, the present invention is particularly applicable to the disposal of waste that is produced at a site away from the disposal site.

Another object of this invention is to provide an economic, safe, and environmentally acceptable method for the disposal of radioactive solid waste which utilizes geopressure source to reduce the processing cost.

Yet another object of this invention is to provide an economic, safe and environmentally acceptable method for the disposal of radioactive solid waste utilizing a geo-water source which contains large amounts of dissolved cations to reduce the processing cost.

Yet another object of this invention is to provide an economic, safe and environmentally acceptable method for the disposal of radioactive solid waste which requires little or no pumping means by utilizing a naturally occurring hydraulic head.

Further yet another object of this invention is to provide a leak-proof and essentially maintenance-free process, which is also operable as a closed system at least at the surface, for the disposal of radioactive solid waste that has been accumulated during the oil and gas production operations.

This invention relates to a waste disposal technique by which solid wastes containing naturally occurring radioactive material can be safely and economically disposed utilizing geothermal means. A preferred embodiment of this invention is to operate the entire solid waste disposal process in a closed system at the surface to provide a leak-proof system requiring essentially no or little effort for maintenance.

During oil and gas production operations, barium sulfate often forms as a scale due a change in the thermodynamic environment. Other scales nay also precipitate from cations such as barium, strontium, calcium, and magnesium and anions such as sulfate, bicarbonate, carbonate, phosphate, and fluoride, etc. While the formation of the scales may cause some operational difficulties, the removal of which have been discussed in the prior art, the major problem involves the deposition of radioactive radium-containing ions on such scales. The presence of the trace amount of radioactive radium makes the entire solid to be classified as radioactive waste. The problem can worsen during deeper wells, usually involving gas producing operations, where the reservoir temperature is higher and the produced water contains higher concentrations of barium or other earth metal ions.

In a preferred embodiment of this invention, the solid waste will be placed in a central waste processing chamber, preferably but not necessarily under a closed condition to allow the maintenance of high pressure. Water is produced from a subterranean formation, preferably at a very deep formation so that the water produced is at elevated temperature. The water produced or fresh water is directed into such a waste processing chamber to dissolve the solid waste to form soluble ions. Since the solubility of barium is extremely small, very large amounts of water will be required. The produced water, after picking up dissolved ions including radioactive ions, is injected into a subterranean formation, preferably another subterranean formation at a reservoir pressure lower than the pressure of the subterranean formation from which the water is produced.

In addition, chemical additions may be required to allow faster and/or more economic dissolution of the barium sulfate scale. These chemical additions might include acids, chelating agents and/or chemicals to convert the barium sulfate scale to a more soluble chemical solid such as barium carbonate. Research has been done to determine effective agents and is shown in FIG. 4.

There are several advantages of using subterranean water to dissolve the solid wastes. First, the produced water is usually readily indictable without further processing such as filtration. Second, as mentioned hereinabove, the subterranean water can be produced from a formation at elevated temperature. For example, at 300 degrees Fahrenheit, the solubility of barium sulfate is increased by about 100-fold compared to room temperature. The amount of water that will be required to treat the solid waste is reduced by a similar factor. Third, the subterranean water is often produced at very high pressure, which further promotes the dissolution of barium sulfate. Fourth, the subterranean water often contains significant amounts of cations such sodium, ferric, ferrous, potassium, magnesium, etc. The presence of such cations reduces the activity of barium ions and further increases the solubility of barium sulfate. Fifth, the preferred embodiment calls for the production of water from a high-pressure subterranean formation and the injection of the treated water into a low-pressure formation. Utilization of such naturally available hydraulic power allows the elimination of a pumping unit and other necessary control implementations. Certain geologic structures, however, may dictate the use of some pumping force. This invention not only substantially saves energy cost for processing the solid waste, it also eliminates many possible leaks which are a major concern in treating radioactive waste.

It may be required to use fresh or city water in the process for efficient dissolution. If this were the case, the dissolution tanks would be jacketed to take advantage of the hot produced water while keeping the chemistry isolated.

The present invention further provides for the disposal of solid NORM as a solution or a slurry or sludge material. In this embodiment, the NORM is ground to a size compatible with the pore space and permeability of the receiving formation and is disposed into the formation via the disposal well. This technique of the present invention does not rely on the formation of a partial vacuum in the disposal well, but relies on the pressure of the production system to drive the disposal process. A partial vacuum in the disposal well due to the high brine density (i.e., the weight of the fluid column) in the disposal well and the high permeability of the disposal reservoir merely enhances the performance of this system. Pumps may be used to supplement the disposal process.

These and other features and advantages of the present invention will be apparent to those of skill in the art from a review of the following detailed description.

DETAILED DESCRIPTION OF THE PREFERRED EMBODIMENT

Figure 1:
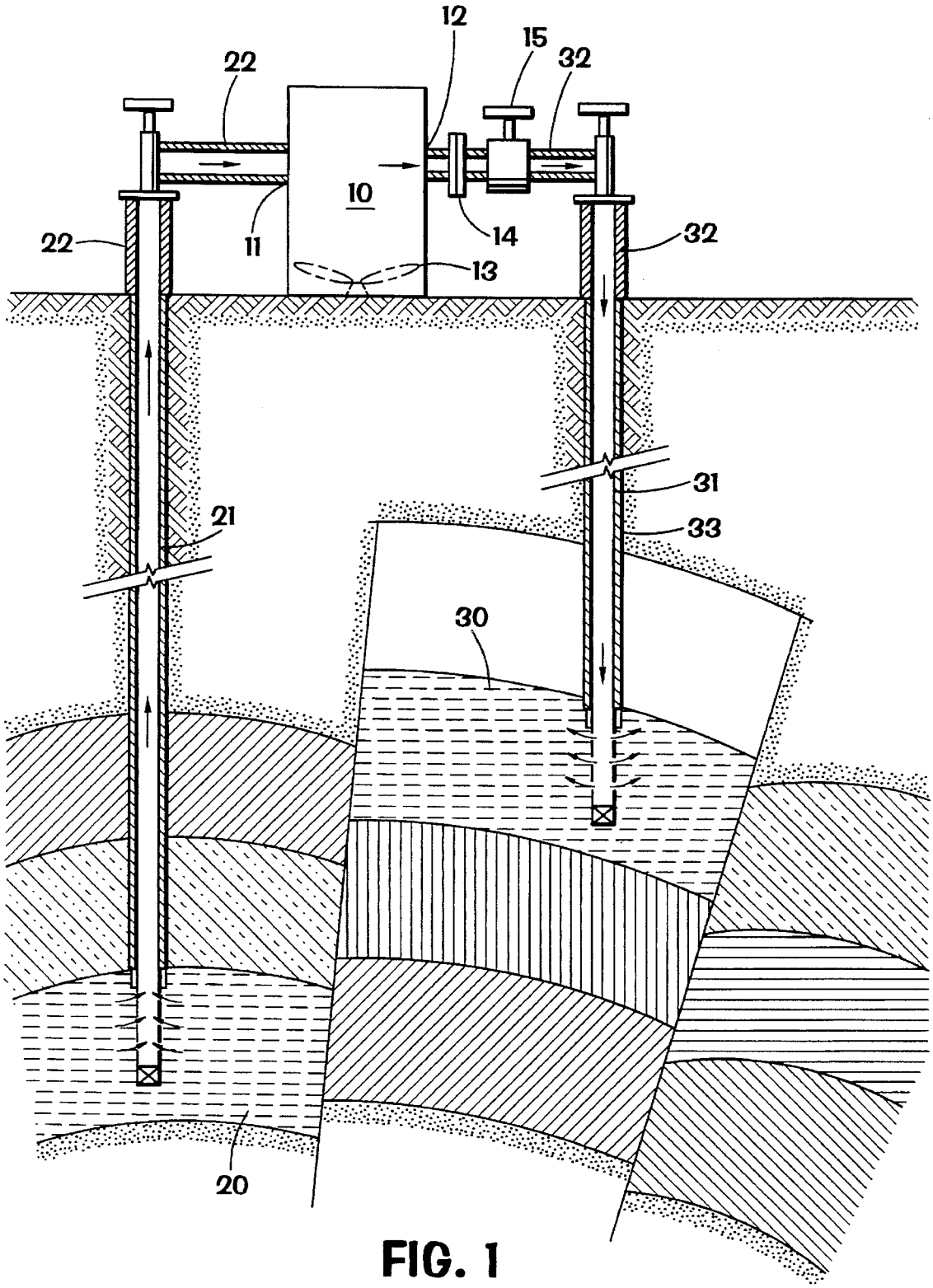
FIG. 1 is a schematic of the solid waste disposal process disclosed in this invention.

FIG. 1 illustrates a schematic flow diagram showing the process disclosed in this invention. Solid waste, which contains mainly barium sulfate and trace amounts of radioactive material such as radium and are accumulated as scales during oil and gas production operations, is sent to a central solid waste processing chamber 10. Other naturally occurring radioactive material such as uranium or thorium may also deposited on the barium sulfate scale. Such solid waste can be delivered to the processing chamber 10 in a continuous manner. However, since the amount of solid waste to be processed is generally not very large, a batch mode is generally adequate. The processing chamber 10 contains an inlet 11 and an outlet 12 for receiving and exiting treatment water, respectively.

The treatment water is produced from a first subterranean formation 20. The first subterranean formation 20 can be an aquifer or a partially or completely depleted hydrocarbon-bearing and water-bearing formation containing movable water. It is preferred that the first subterranean formation has a relatively high formation temperature, preferably at or above 300 degrees Fahrenheit. Such a high temperature is preferred because the solubility of barium sulfate increases significantly with temperature. It is also preferred that the produced water contains large amounts of other dissolved cations such as sodium, potassium, calcium, magnesium, ferric, ferrous, etc. It is well-known that the presence these cations decreases the activity of barium ions and thereby increases the solubility of barium sulfate. Therefore, it is preferred that the produced water contains at least 3% of total dissolved solids. Water is produced from the first subterranean formation 20 and delivered through a subsurface tubing system 21 and a surface tubing stem 22 into the inlet of the solid processing chamber 11.

The solid processing chamber 10 may be provided with a mixing means 13, such as an impeller, a rotating rake, or any turbulence generating means. The solid processing chamber 10 should have enough space to provide enough residence time to achieve saturated or nearly saturated barium solution, in order to reduce the amount of water required. Water containing dissolved ions exits the solid processing chamber 10 through an exit means 12. Since pressure improves the dissolution of barium ions, it is preferred that a valve 15 or other pressure-maintaining means be placed at or after the exit means 12 to maintain means be placed at or after the exit means 12 to maintain a desired pressure inside the solid processing center 10. After the solid processing chamber 10, the treated water is injected into a second subterranean formation 30 via an injection surface piping system 32 and an injection subsurface tubing system 31. To maintain the treatment water at the desired temperature, it is preferred that all the surface pipes be insulated to prevent or minimize heat loss. Optionally, a heating means can be provided in the solid processing chamber 10. However, since the amount of water to pass through the processing chamber 10 is very large, it may not be practical to apply such external heat. A filter means 14 can be provided at or after the exit means 12 to avoid causing wellbore damage due to undissolved solids.

The second subterranean formation 30 can be an aquifer or a hydrocarbon-bearing formation. It is preferred that the second subterranean formation 30 is a partially or completely depleted oil or gas reservoir. It is further preferred that the second subterranean formation 30 is a partially or completely depleted gas reservoir because of its favorable compressibility. In the preferred embodiment, the first subterranean formation 20 has a substantially greater formation pressure than the second subterranean formation 30. Such a naturally available hydraulic head allows the treatment water to circulate the solid waste treatment system of this invention without any externally applied pumping means. Since pumps are often the major source of fluid leaks, the process disclosed in this invention provides an essentially leak-proof and maintenance-free system for the disposal of radioactive solid waste in a safe, economic and environmentally acceptable manner.

If the second subterranean formation underlies one or more permeable subterranean formations, the space between the injection subsurface tubing system 31 and the wellbore 33 should be carefully cemented to prevent any slippage of the injection water into any of the formations. Such a cementing is also desirable about the production subsurface tubing system 21. Most of the radioactive material contained in the injected water will be absorbed by the reservoir rocks in the second subterranean formation, therefore, they are stored in a very safe and environmentally acceptable manner.

Figure 2:
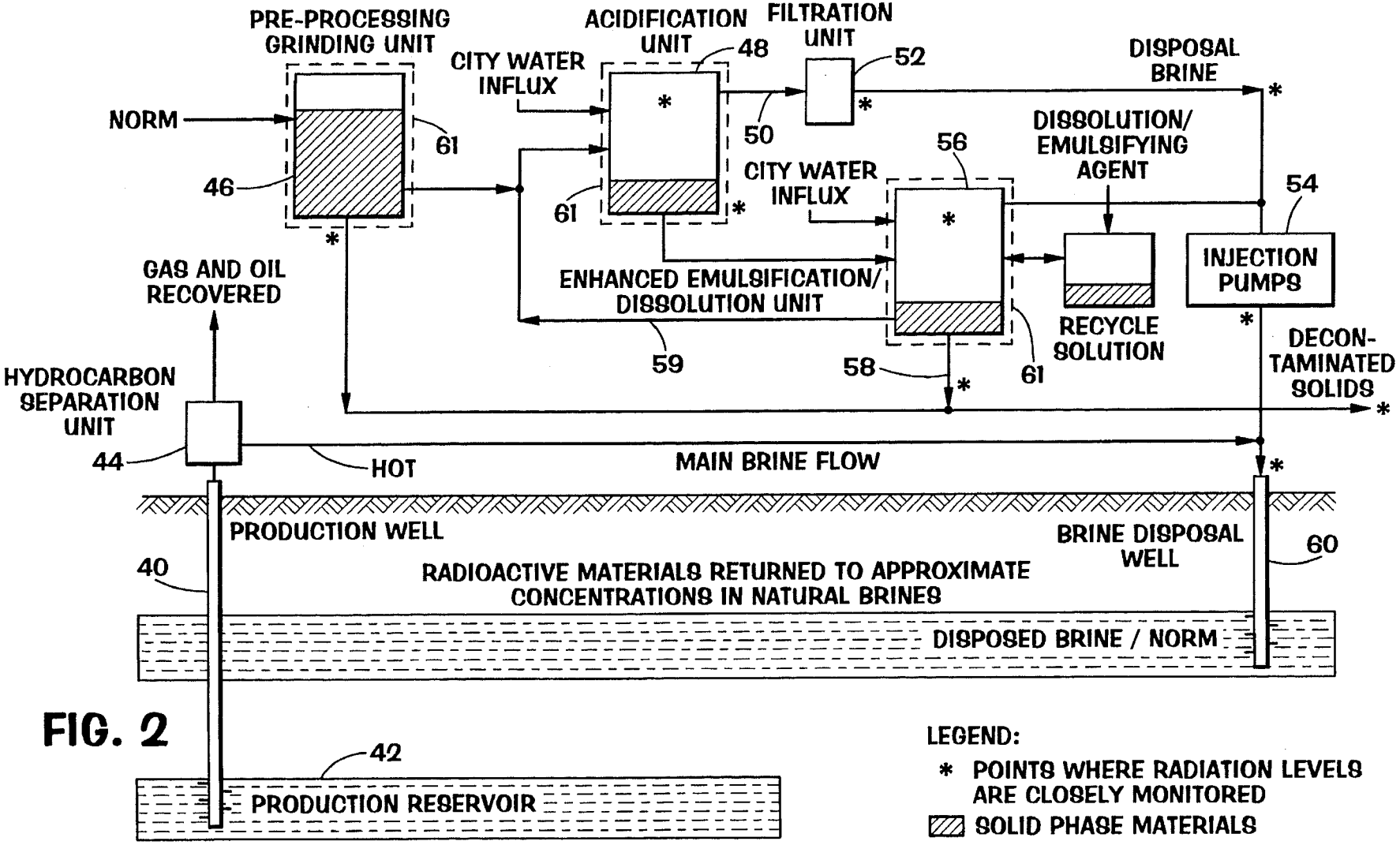
FIG. 2 is a three dimensional plot illustrating the variation of solubility of naturally occurring radioactive material with temperature.
Figure 3:
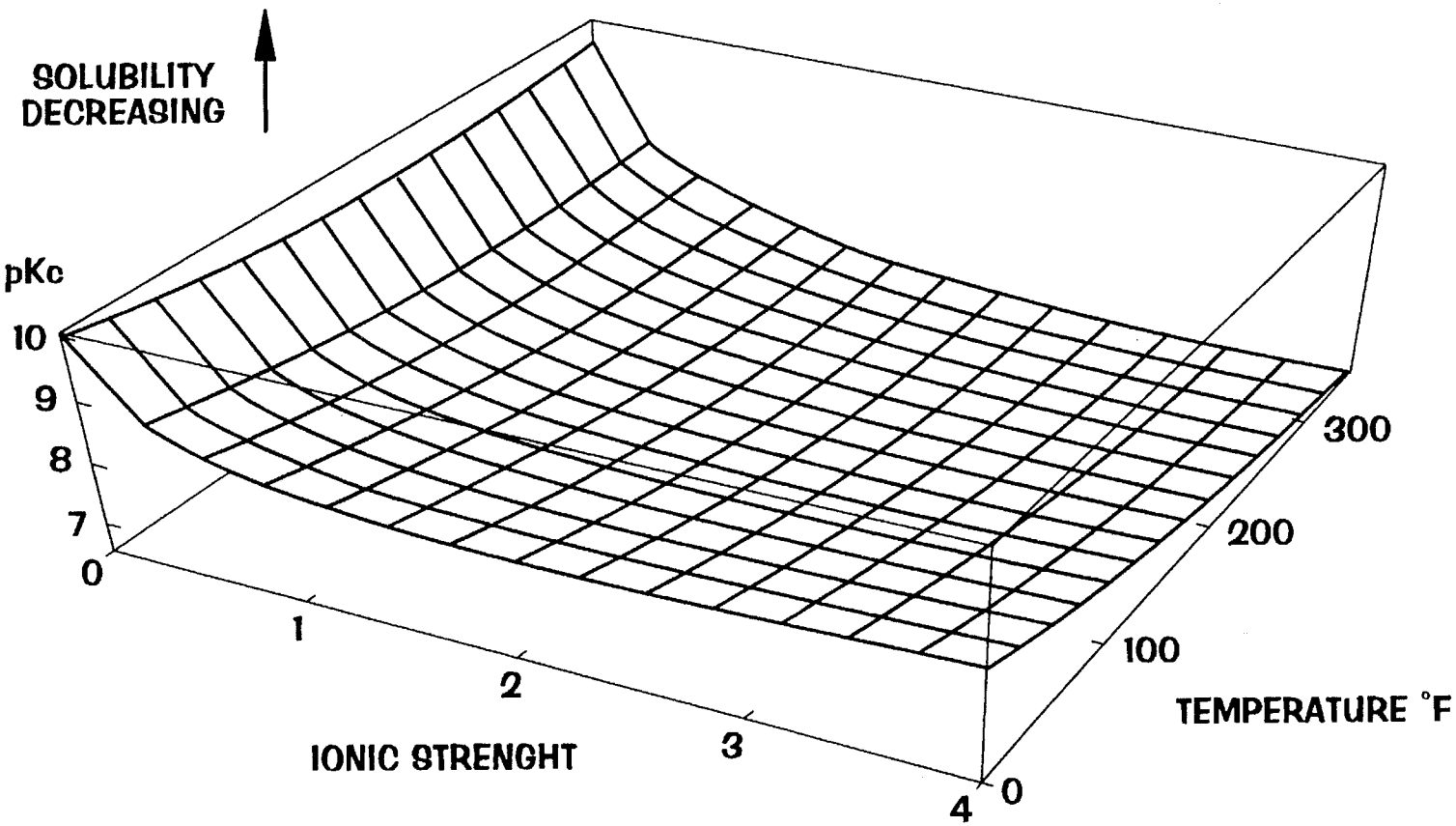
FIG. 3 is a schematic of the solid waste disposal system of the present invention, illustrating the primary fluid handling elements of the system.
Figure 4:
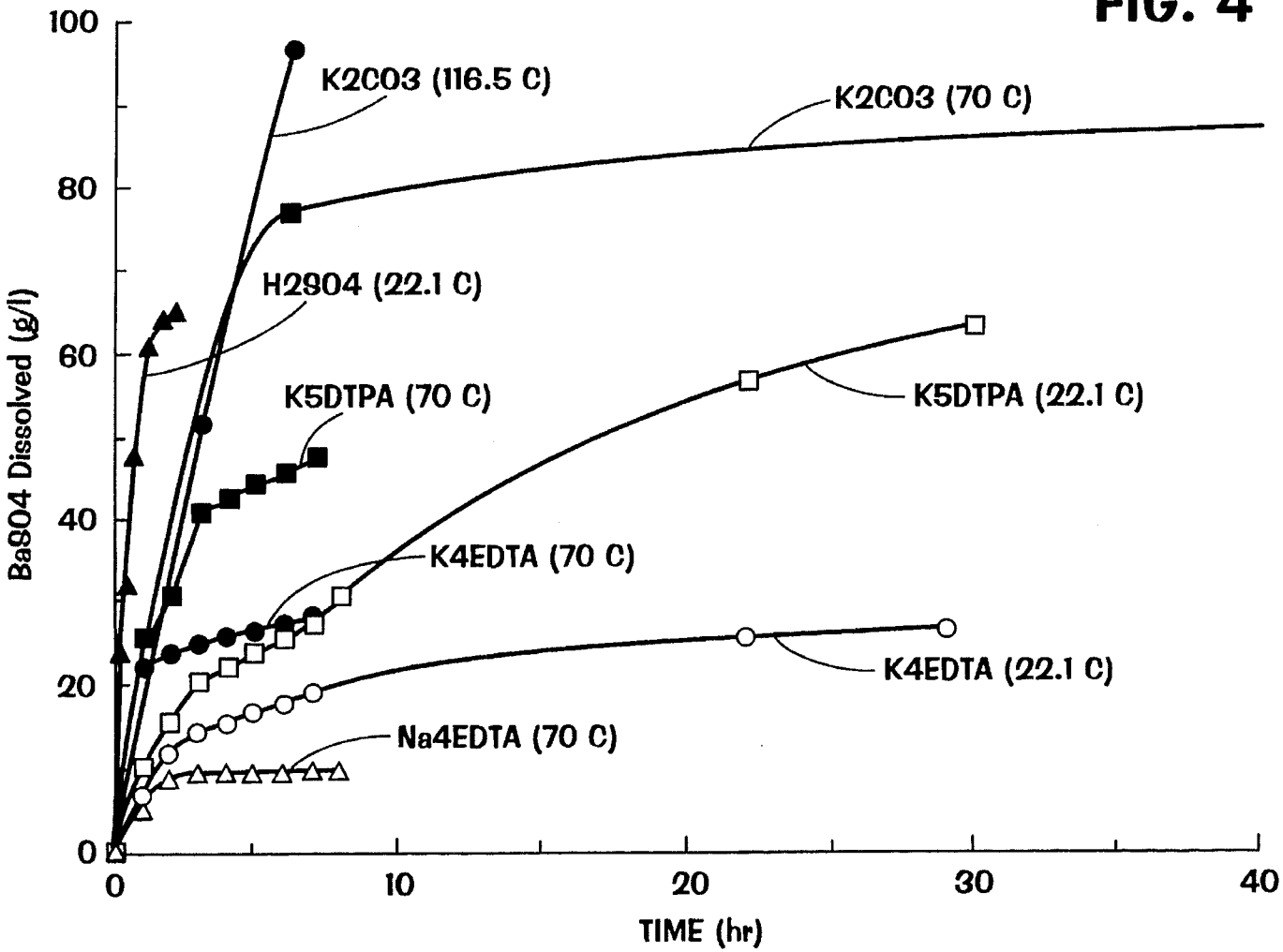
FIG. 4 is a plot of experimental results of the dissolution of barite employing the present invention.

FIG. 2 depicts a schematic of the primary flow paths to carry out the present invention. The asterisks in FIG. 2 depict the points in the process of radiation monitoring.

A production well 40 penetrates a production reservoir 42 and production fluid is forced under pressure or is drawn to a hydrocarbon separation unit 44. The hydrocarbon separation unit separates water and hydrocarbons from the production well 40. It typically consists of a heater/treater, chemical injection equipment for scale and emulsion control, a separator, a gas dehydrator, and associated piping. In known production systems, the separator 44 throughputs the produced water to a disposal well.

A pre-processing/grinding unit 46 prepares naturally occurring radioactive material (NORM) for a subsequent dissolution or microemulsion processing. The unit 46 consists of a hydrocarbon separation unit where any liquids associated with the NORM are removed and recovered, if the concentration of the NORM is sufficiently high to make this process economically feasible. Separation of hydrocarbon liquids from the NORM in the unit 46 may further require de-emulsifying chemicals. When the hydrocarbons have been removed from the NORM, the unit also provides a means of wet grinding for reduction of the particle size of the solid waste.

Slurry from the grinding unit 46 is passed to an acidification unit 48. This unit 48 comprises a process tank or vessel. NORM solids that are acid soluble, as well as non-NORM acid soluble materials, are removed in the acidification unit 48. Although barium sulfate is not very soluble in acid, other scale materials that are included with the barium sulfate are indeed soluble in acid. Such material include calcium and iron carbonate. Liquids and gases from this unit are injected into the produced brine for disposal into a disposal well 60 through an outlet line 50. The liquids and gases from the acidification unit 48 pass through a filtration unit 52, before injection into the disposal well, to minimize plugging of the disposal injection well 60. To assist in the injection of fluids into the disposal well, the system may include injection pumps 54, although with proper AP, the pumps are not required.

Effluent from the acidification unit 48 passes to an enhanced emulsification/dissolution (EED) unit 56 which also comprises a process vessel or tank. Solid materials are passed from the acidification unit for dissolution of micro-emulsion (slurry) formation and disposal. If the process is micro-emulsion disposal, the solids from the EED unit 56 are disposed of downhole through a discharge line 58. If dissolution is used in the process, the solids from the EED unit 56 are returned to the acidification unit 48 via a return line 59 and water is disposed downhole into the well 60.

As shown in FIG. 2, each of the pre-processing grinding unit 46, the acidification unit 48, and the EED unit 56 is encased in a jacket 61.

In the present invention, solutions and gases and/or the microemulsion are disposed of in the disposal well 60. No gases or solutions, other than the recyclable reagents, are left on the surface. When reagents are expended, they are disposed of, along with other waste, down hole. No "live" acid is injected into the disposal well since the acid is neutralized before disposal. With proper management of the surface pressure of the system, the pressures push the fluids through the disposal well and no pumps are required for this purpose. However, certain geologic structures may require the use of pumps.

As shown in FIG. 2, radioactivity is monitored at a number of points in the system to insure worker safety, as well as the environmental integrity of the system. Although it is assumed that some solid material will remain at the end of the disposal scheme, these will consist of produced sands and fines that are non-NORM and not readily soluble. These material are continuously monitored for radiation. No solids are released into the environment that violate regulations concerning NORM.

This invention discloses a process for the safe and economic disposal of solid waste that contains radioactive material. Although the best mode contemplated for carrying out the present invention has been herein shown and described, it will be apparent that modification and variation may be made without departing from what is regard to be the subject matter of the invention. For example, although this invention contemplates to be most applicable in oil and gas production operations, it can be equally applicable to dispose radioactive solid wastes generated from other sources.

I claim:

1. A solid-waste disposal system for disposing solid waste containing radioactive material, the solid-waste disposal system comprising:

a. a producing means for producing water from a first subterranean geological formation;

b. a source of radioactive material;

c. a grinder for receiving radioactive material from the source and reducing the radioactive material to a slurry of microemulsion particle size, a portion of the slurry being soluble in acid;

d. an acidification unit for receiving the slurry from the grinder and treating the slurry with an acid to dissolve the acid soluble portions of the slurry and to produce and disposal brine; and e. an injecting means for injecting said dilute solution into a second subterranean geological formation.

2. The solid-waste disposal system of claim 1 wherein said radioactive material comprises naturally occurring radioactive materials selected from the group consisting of barium, uranium, radium, and thorium.

3. The solid-waste disposal system of claim 1 wherein said solid waste comprises in major portion alkaline earth sulfates.

4. The solid-waste disposal system of claim 1 wherein said solid waste comprises in major portion barium sulfate.

5. The solid-waste disposal system of claim 1 wherein said solid waste comprises in major portion barium sulfate and said radioactive material comprising in major portion radium.

6. The solid-waste disposal system of claim 1 further comprising a filter device in fluid communication with the acidification unit to prevent the injection of undissolved solid waste into said second subterranean geological formation thereby causing injectivity problems.

7. The solid-waste disposal system of claim 1 wherein said first subterranean formation is a geothermal source having an average formation temperature above 200° F. to facilitate the dissolution of said solid waste and said radioactive material contained therein.

8. The solid-waste disposal system of claim 7 wherein said average formation temperature is above 300° F.

9. The solid-waste disposal system of claim 1 wherein said first subterranean geological formation has an average formation pressure substantially greater than said second subterranean geological formation.

10. The solid-waste disposal system of claim 9 wherein said injecting means involves a naturally available mechanism by which water is driven through the entire system via a pressure difference between said first subterranean formation and said second subterranean formation without any externally applied pumping means.

11. The solid-waste disposal system of claim 1 further comprising outlet means from the acidification unit and valve means or other flow constricting means in fluid communication with the outlet means to maintain a high pressure environment inside said acidification unit to facilitate the dissolution of said solid waste and said radioactive material.

12. The solid-waste disposal system of claim 11 wherein said washing chamber being maintained at a fluid pressure above 1,000 psi.

13. The solid-waste disposal system of claim 11 wherein said washing chamber being maintained at a fluid pressure above 2,000 psi.

14. The solid-waste disposal system of claim 1 wherein said water produced from said first formation containing at least 3% of total dissolved solids to facilitate the dissolution of the solid waste.

15. The solid-waste disposal system of claim 14 wherein said water produced from said first formation containing at least 10% of total dissolved solids to facilitate the dissolution of the solid waste.

16. The solid-waste disposal system of claim 1 wherein said first formation is an aquifer.

17. The solid-waste disposal system of claim 1 wherein said first formation is a partially or wholly depleted hydrocarbon-bearing reservoir.

18. The solid-waste disposal system of claim 1 wherein said second formation is a partially or wholly depleted hydrocarbon-bearing reservoir.

19. The solid-waste disposal system of claim 18 wherein at least a portion of said second formation is partially or completely filled with gaseous components.

20. The solid-waste disposal system of claim 1 wherein said second geological formation is overlaid by a plurality of geological strata wherein:

(a) said second formation being communicated with surfaces through a well penetrating said strata;

(b) said well comprising a bore hole, a casing string within said bore hole, and optionally a tubing string contained within said casing string to prevent flow of said dilute solution into any of said geological strata; and (c) said well further comprising a cementing means between said bore hole and said casing string to further prevent any leakage of said dilute solution into any of said geological strata.

21. A method of disposing of solid radioactive waste comprising the steps of:

a. drawing water from a first subterranean formation;

b. grinding solid radioactive waste in a grinding unit to form a slurry of microemulsion particle size, the slurry having a soluble portion and an insoluble portion;

c. treating the slurry with an acid to dissolve the soluble portion of the slurry, producing an effluent having a liquid portion and a solid portion;

d. emulsifying the solid portion of the effluent to a smaller size to develop a solid disposable sludge;

e. mixing together the solid disposable sludge, the liquid effluent, and the water drawn from the first subterranean formation to produce a disposal mixture; and f. disposing of the disposal mixture in a second subterranean formation.

22. The method of claim 21 wherein the first subterranean formation having a formation pressure substantially greater than the second subterranean formation to allow the circulation of the water from said produced water from said first subterranean formation to said second subterranean formation without any externally applied pumping means.

* * * * *